United States Patent [19]

Rigsby

[11] 4,346,058

[45] Aug. 24, 1982

[54] DUAL LID TYPE COAL WASHABILITY TABLE WITH BUILT-IN AIR VENTILATION SYSTEM

[75] Inventor: Lee S. Rigsby, Ashland, Ky.

[73] Assignee: Ashland Coal, Inc., Huntington, W. Va.

[21] Appl. No.: 254,702

[22] Filed: Apr. 16, 1981

[51] Int. Cl.[3] ..... B01L 9/00

[52] U.S. Cl. ..... 422/104; 98/115 LH; 209/172

[58] Field of Search ..... 209/172; 55/270; 98/115 LH; 4/347, 348, 350, 352; 422/104

[56] References Cited

U.S. PATENT DOCUMENTS

| | | | |
|---|---|---|---|
| 994,950 | 6/1911 | DuPont | 209/172 |
| 1,934,808 | 11/1933 | Liptay | 422/104 X |
| 2,150,917 | 3/1939 | Foulke | 209/172 |
| 3,121,618 | 2/1964 | Yerzley | 422/104 X |
| 3,273,170 | 9/1966 | Wheeler | 4/348 X |
| 3,376,583 | 4/1968 | Frey | 98/115 LH |
| 4,117,559 | 10/1978 | Boyle | 4/348 X |
| 4,133,660 | 1/1979 | Webb | 4/352 X |
| 4,179,984 | 12/1979 | Gorcey | 98/115 LH |
| 4,185,072 | 1/1980 | Puderbaugh | 422/104 X |

*Primary Examiner*—Ralph J. Hill

*Attorney, Agent, or Firm*—Sughrue, Mion, Zinn, Macpeak & Seas

[57] ABSTRACT

An elongated rectangular open frame table supports a rectangular sump tank open at its top and mounted below the top of the open frame and spaced from the ends and the rear of the frame. A recessed sink is formed by inclined table sink drain sheets which extend from the rear and sides of the sump tank to the table top. A pivotable first lid overlies the open top of the table frame to seal off the recessed sink and the sump tank. A removable second lid overlies the open top of the sump tank to selectively close off the recessed sink volume from the sump tank. Air register openings provided within the rear table sink drain sheet adjacent the sump tank connect via a vertical tubular ducts, to an underlying main air tube subjected to low vacuum pressure for removing toxic vapors from the recessed sink during the performance of separation tests on coal submerged within liquid provided to the sump tank. A removable, elongated support shelf is mounted and extends across the rear of the sink recessed below said access opening from one lateral sloped wall portion to the other and overlies a part of the sump tank for resting beakers or the like thereon employed in the testing process.

6 Claims, 4 Drawing Figures

FIG. 3
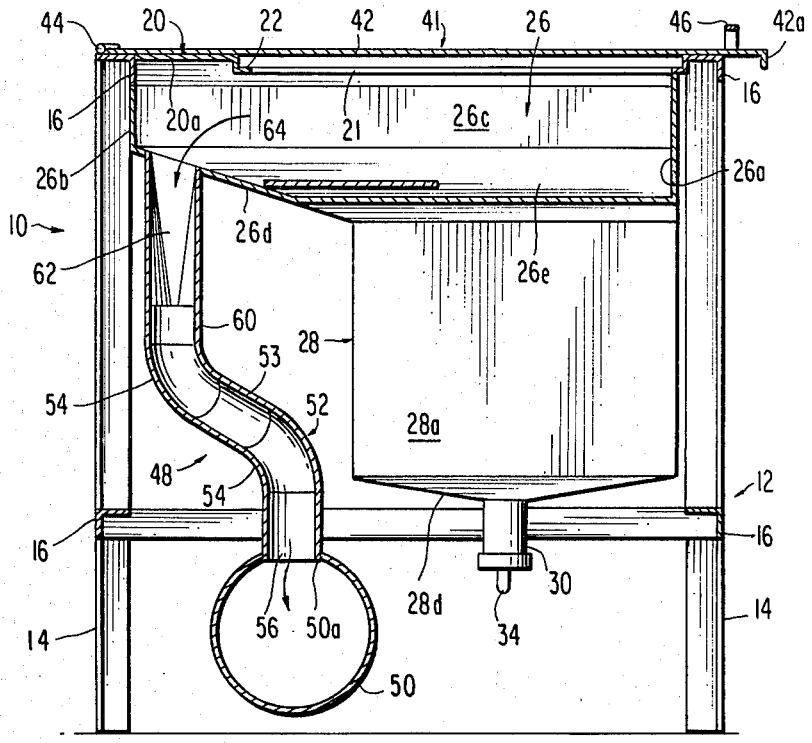
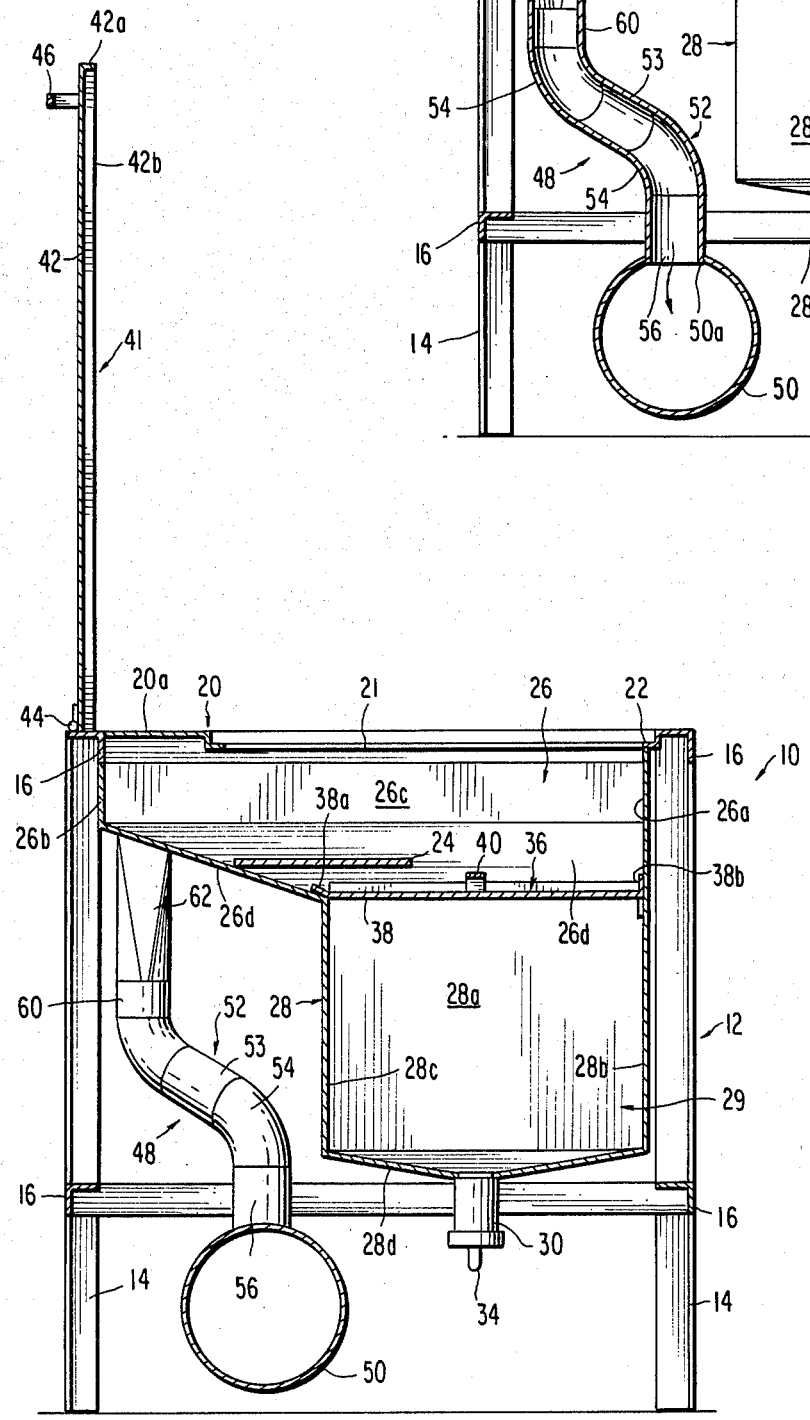
FIG. 4

DUAL LID TYPE COAL WASHABILITY TABLE WITH BUILT-IN AIR VENTILATION SYSTEM

BACKGROUND OF THE INVENTION

This invention relates to the conducting of separation tests on coal by the submersion of coal in various organic liquids of different specific gravity, and more particularly, to an improved coal washability table with means for effective control of toxic vapors both during the running of the tests, and when the table is not in use.

Conventionally, coal separation testing is achieved by the immersion of a basket of coal, sequentially within a series of organic liquids carried respectively by multiple tanks normally located side-by-side. Depending upon the specific gravity of the coal (determined principally by its ash content) and that of the organic liquid within which the coal is immersed, the percentage of coal having a particular ash content may be readily determined as a result of the amount of floatation of the coal within a given tank. Typically, such tanks have been formed of stainless steel and the tank borne organic liquid tends to create toxic and/or noxious vapors which may be hazardous to the person conducting the tests.

Efforts have been made within recent years in conformance with governmental requirements, to eliminate such hazardous exposure of the test personnel of toxic vapors resulting from the coal washability tests.

In the chemical testing field, attempts have been made to provide sink constructions or multiple tank arrays which are open at the top to permit the placement and removal of objects within the sump area or tank and wherein ventilation is provided to the sump area itself or to portions of the apparatus immediately surrounding the sump to reduce the hazardous exposure of the operator or test personnel to toxic vapors resulting from such tests.

One type of sink construction employing a built-in ventilation feature appears in U.S. Pat. No. 3,376,583 issued to L. O. Frey, Apr. 9, 1968.

The sink construction of that patent takes the form of a rectangular sink bearing a recessed basin mounted within the center of a counter or table top and centered with respect to the longitudinal ends of the table. The basin is surrounded by a shell of larger size to form a narrow air space therebetween. The shell terminates at its top in a laterally extending flange forming a horizontal frame, the flange being provided with a right angle lip projecting into the interior of the basin; whereby, a vapor removal passage is formed between the basin and the shell. This passage is connected to a vacuum fan by way of a pipe to remove the vapor from the immediate area of the basin, which vapor is generated within the basin proper.

While the air ventilation means is quite effective in removing vapor generated within the basin itself, it has little effect on vapors existing or generated exterior of the basin and to the lateral sides or to the rear of the sink.

Where a plurality of tanks bear hot solutions of chemical substances within which metal parts may be dipped for cleaning purposes, attempts have been made to provide air ventilation to the surface area of the liquids carried by the tanks so as to exhaust noxious fumes eminating therefrom, commonly through a duct system coupled to ventilation means cooperating with one or more of the tanks. U.S. Pat. No. 2,110,991 to Carl S. Gabelson, issued Mar. 15, 1938, is representative of such tank constructions. In that apparatus, a plurality of open top rectangular tanks are mounted side-by-side, and being spaced slightly from each other in some cases, to define vertical ventilation paths between laterally opposed sidewalls of respective adjacent tanks. Further, the bottoms of the tanks are supported at some height relative to a common casing surrounding all of the tanks to therefore define a common longitudinal flow path leading to a common collector duct subject to a slight vacuum pressure and acting to remove vapor generated within the interior of the tanks and moving into the common duct by way of the vertical passages formed by the sidewalls of adjacent tanks. Again, this type of air ventilation for ventilating the interior of the tanks acts to remove vapors generated within the tanks themselves, but has little effect on vapors emanating from the outside or created in the vicinity of the sump tanks bearing the liquid chemicals.

Within the more recent times, noxious or toxic vapors have been removed from an immediate work area by utilization of expensive and complicated clean room work stations involving hoods overlying the work area. Blowers and the like provide positive air pressure zones or the creation of vacuum pressure air flow through a frontal access opening and into the work station area to prevent the toxic or noxious vapors from penetrating the exterior of the work area. Normally only the operator's hands project into the work area. While such apparatus permits removal of the toxic vapors from the open top of a sump tank, or basin bearing liquid chemicals along with vapors generated or penetrating the areas to the side of such sump tanks or liquid chemical containing basins, such apparatus is complicated and expensive. Representative of such approaches are U.S. Pat. No. 3,728,866 to Howard M. Layton, issued Apr. 24, 1973, and U.S. Pat. No. 4,179,984 to Raymond A. Gorcey, issued Dec. 25, 1979.

It is, therefore, a primary object of the present invention to provide an improved dual lid type coal washability table with built-in air ventilation which operates effectively to remove toxic vapors in the work area above an open top sump tank bearing organic chemical liquids or the like and in the work area to the rear and sides thereof.

It is a further object of the invention to provide such a dual lid type coal washability table which does not interfere with the normal test procedure and which readily permits the sealing off of both the sump tank itself and a recessed sink borne by the testing table and opening at its center to the top of a sump tank which depends therefrom.

It is also an object of the present invention to provide such an improved dual lid type coal washability table with built-in air ventilation in which the air ventilation means for the table may be readily coupled to a main vapor removal duct commonly servicing a plurality of similar testing tables to either end thereof.

SUMMARY OF THE INVENTION

An elongated rectangular open frame formed by welded angle bars supports a rectangular sump tank open at its top and mounted below the top of the open frame and being spaced from the ends and the rear of the frame and mounted adjacent to the front of the open frame. A recessed sink is formed by inclined table sink drain walls which extend from the rear and sides of the open frame to respective rear and opposed side edges of the sump tank and being sealed thereto. A pivotable first lid overlies the open top of the table frame to seal off the recessed sink and the sump tank. A removable second lid overlies the open top of the sump tank to selectively close off the recessed sink volume from the sump tank interior. At least one air register opening is provided within the table sink rear drain wall adjacent the sump tank and connects via a vertical tubular duct, to an underlying main air ventilation tube subjected to low vacuum pressure for removing toxic vapors from the recessed sink and sump tank during the performance of separation tests on coal submergable within an organic liquid provided to the sump tank. Preferably, register openings are provided within the rear sink drain sheet on opposite sides of the sump tank. A recessed lip extends about the opening within the counter of the table defining an access opening to the recessed sink. A removable, elongated support shelf is mounted across the rear of the sink, recessed below the access opening from one inclined wall of the sink to the other, overlying a part of the sump tank and allowing beakers or the like employed during the testing process to rest thereron.

BRIEF DESCRIPTION OF THE DRAWINGS

FIG. 3 is a vertical sectional view of the table shown in FIG. 1 taken about lines 3—3, with the upper lid in horizontal, sink closed position.

FIG. 4 is a vertical sectional view of the table shown in FIG. 1 taken about lines 4—4, with the upper lid in vertically raised position.

DESCRIPTION OF THE PREFERRED EMBODIMENT

Figure 1:
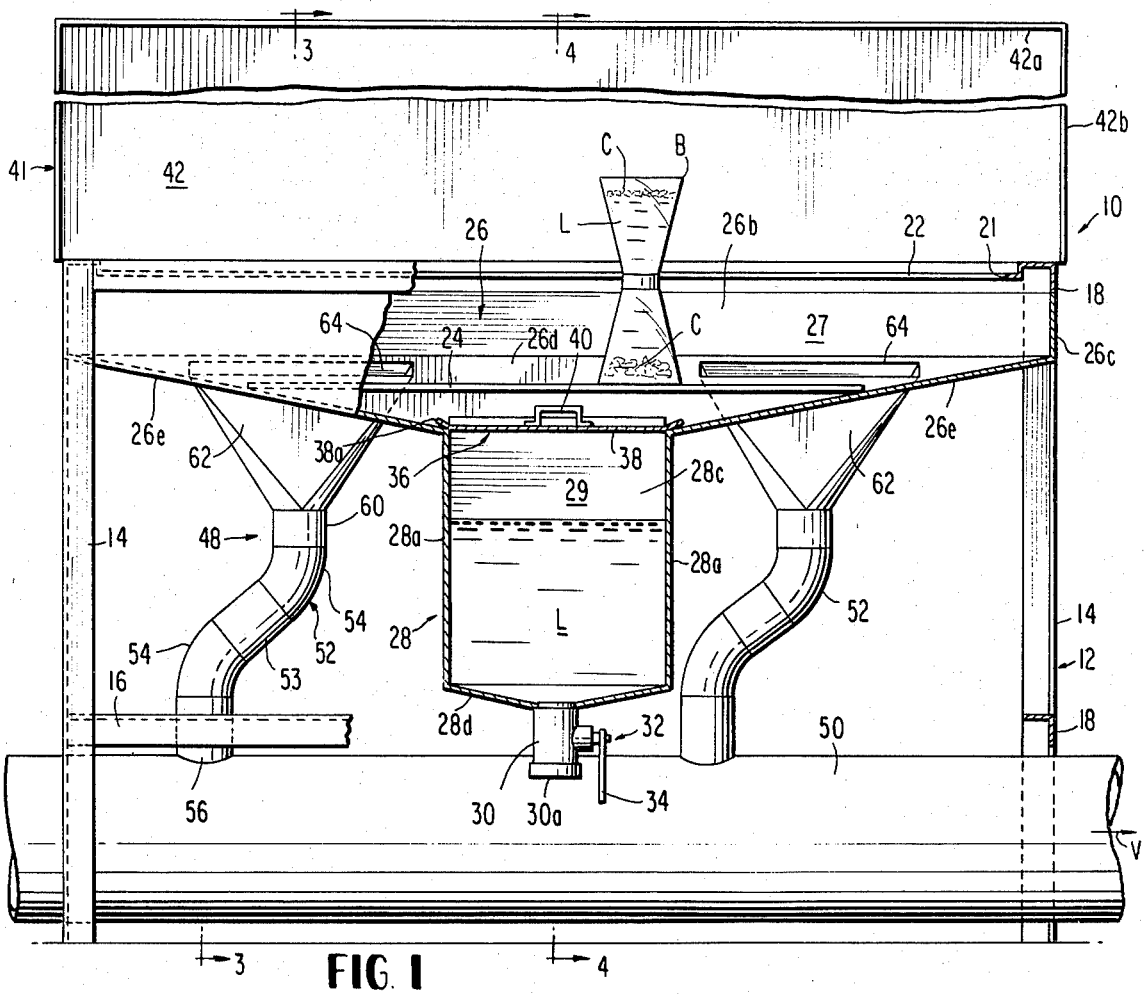
FIG. 1 is a front elevational view, partially broken away, of the improved dual lid type coal washability table forming a preferred embodiment of the present invention, with the upper lid pivoted to raised position above the sink.

Referring to the drawings, the improved dual lid type coal washability table with built-in air ventilation is indicated generally at 10. The table includes an elongated rectangular open table frame indicated generally at 12, being formed of welded stainless steel angle bars including four vertical table legs 14, which are of a length such that the top of the table 10 is essentially waist high. Welded to the table legs 14 are four side beams or angle bars 16 and four end beams or angle bars 18. The angle bars extend along the sides and ends, one at the top of the table legs 14 and one at some distance intermediate of the tops and bottoms of the legs. The horizontal angle bars 16 and 18 are welded at their ends to the vertical legs 14, thus forming an open frame.

The open frame 12, at its top is partially covered over by a horizontal counter or tabletop, indicated generally at 20, formed of sheet stainless steel or the like and defining a rectangular opening 21 which extends generally the length of the table. It is closed off towards the rear, and is open to the front. A depending, offset lip 22 is provided to member 20 which defines opening 21. In that respect, the table top or counter 20 includes a relatively wide portion **20*a* at the rear, and narrow counter portions at 20*b*** along respective ends of the table.

An important element in the coal washability table resides in the recessed sink, indicated generally at 26, constituting a recessed member mounted within the counter 20. Sink 26 is formed by sheet metal either integrally or as separate sheets edge welded or otherwise coupled together and to the frame 12. Sink 26 may be formed of stainless steel or the like. In this respect, the sink 26 is formed by a vertical front wall portion **26*a*, a rear vertical wall portion 26*b*, the upper ends of which are perferably welded to both a side angle bar 16 and to a suitable portion of the counter 20. Sink 26 also includes longitudinally spaced end wall portions 26*c*. One aspect of the invention resides in providing sloped or inclined drain wall portions for the sink 26. These sloped wall portions extend downwardly from the outer edges of the sink towards the center of the sink from longitudinally opposed integral vertical sidewall portions 26*c*, FIG. 1, and the vertical rear wall portion 26*b* of the sink, as at 26*e* and 26*d*, respectively. The sloped wall portions 26*c* permits the recess placement of a removable beaker support shelf or plate 24 below the top of the table 10. The shelf 24 is of a width slightly less than half the lateral width of opening 21 and is of a length slightly less than the length of opening 21. The ends of the shelf 24 (as well as the rear edge) are thus supported by sloped walls 26*e* and 26*d* when the shelf is positioned as shown in the drawings. This permits, in FIG. 1**, one or more beakers B bearing coal C and separation liquid L to be positioned thereon as may be required during the coal washability tests.

Mounted to the longitudinal center of the sink 26 is a separate or integrally formed sump tank indicated generally at 28 of rectangular plan configuration and being formed of laterally opposed sidewalls **28*a*, FIG. 1, and front and rear walls at 28*b* and 28*c*, respectively. The top of tank 28 is open, that is, it merges into the recessed sink cavity. The tank 28 is closed at its bottom by inclined bottom walls 28*d* which incline downwardly towards the center thereof. The center bears a stainless steel drainage valve 30 such as a Gemni ball valve. The ball valve is cylindrical in form, opens at its bottom as at 30*a* and is provided with a valve actuator mechanism indicated generally at 32 including a rotatable handle 34. As may be appreciated, the sump tank interior 29 bears a suitable volume of organic chemical liquid L capable of providing a specific gravity useful in determining the ash content of the coal when a bucket of coal (not shown) is submerged into the liquid L when the sump tank lid, indicated generally at 36, is removed therefrom. In that respect, the removable lid tank 36 is formed by a rectangular sheet metal plate 38 formed of stainless steel or the like. Plate 38 includes laterally inclined flanges or lips 38*a*, to the rear and to the sides thereof, and a right angle flange portion 38*b* at the front of the lid which lies against 28 and projects upwardly along the side of the sink front wall 26*a* where it merges with front wall 28*b*** of tank.

A inverted U-shaped handle 40 is mounted to the lid 38 by riveting or the like to permit hand lift removal of the lid 38 from the tank 28 as desired.

As may be appreciated, the utilization of the sump tank lid 36 provides a first barrier preventing the escape of noxious or toxic fumes to the exterior of that tank and permeating the atmosphere in the vicinity of the testing table. Further, the table is provided with a second lid in the form of a sink lid indicated generally at 41 and functioning to selectively cover opening 21 within counter 20 and thus the underlying recessed sink cavity. In that respect, the sink lid 41 is formed of a rectangular metal sheet 42, such as stainless steel and being dimensioned to the counter 20 so as to overlie the same. Sheet 42 has a length slightly longer than the length of the table frame 12 and of a width in excess thereto. The sink lid 41 is hinged along the rear by means of hinges 44 so that it may be pivoted between a horizontal position overlying and sealing off the opening 21 within counter 20, FIGS. 2 and 3, and a raised position which may be vertical and 90 degrees thereto as indicated in FIGS. 1 and 4. An inverted U-shaped handle similar 46 to handle 40 is riveted or otherwise affixed to the top of lid 40, near the front thereof, such that the inverted U-shaped member may be readily grasped to raise the lid to the position shown in FIG. 4. Flanged edges are provided as at **42*a* on the front of the lid and at 42*b* to each side thereof. The lid 41, when closed, provides surface to surface contact with the counter 20 over the complete surface thereof. Further, the edges 42*b* at the side generally conform to the edge of the table frame as defined by the end angle bars 18 and the sheet 42 forming the lid proper, is of a lateral width such that there is a few inches of overhang at the front of the table as seen in FIG. 3**.

A major aspect of the present invention resides in the arrangement for venting the recessed sink where work is accomplished, this being effected by the ventilation system indicated generally at 48. In that respect, there is mounted beneath the sink 26 and to the rear of the sump tank, a main air duct indicated generally at 50 which extends longitudinally and which may be utilized as a common duct for venting a plurality of such tables 10 when mounted end-for-end, in an array. The interior of the sink and thus the working area of the test tables may thus be commonly vented to a single discharge point wherein a blower (not shown) may function to provide a slight vacuum interiorly of longitudinal duct 50 as per arrow V, FIG. 1. Rising from this duct 50 to each side of the sump 28 are ventilation tube assemblies indicated generally at 52 and comprised of multiple tube sections which are end-to-end joined and sealed. These sections may be formed of stainless steel, as preferably, is the air duct 50. The sections include straight section 53, elbows at 54, and a terminal connection tube 56 which is sealably mounted to a hole **50*a* within the large diameter air duct 50 and which may be welded about its periphery to effect coupling or connection to duct section 56**.

Figure 2:
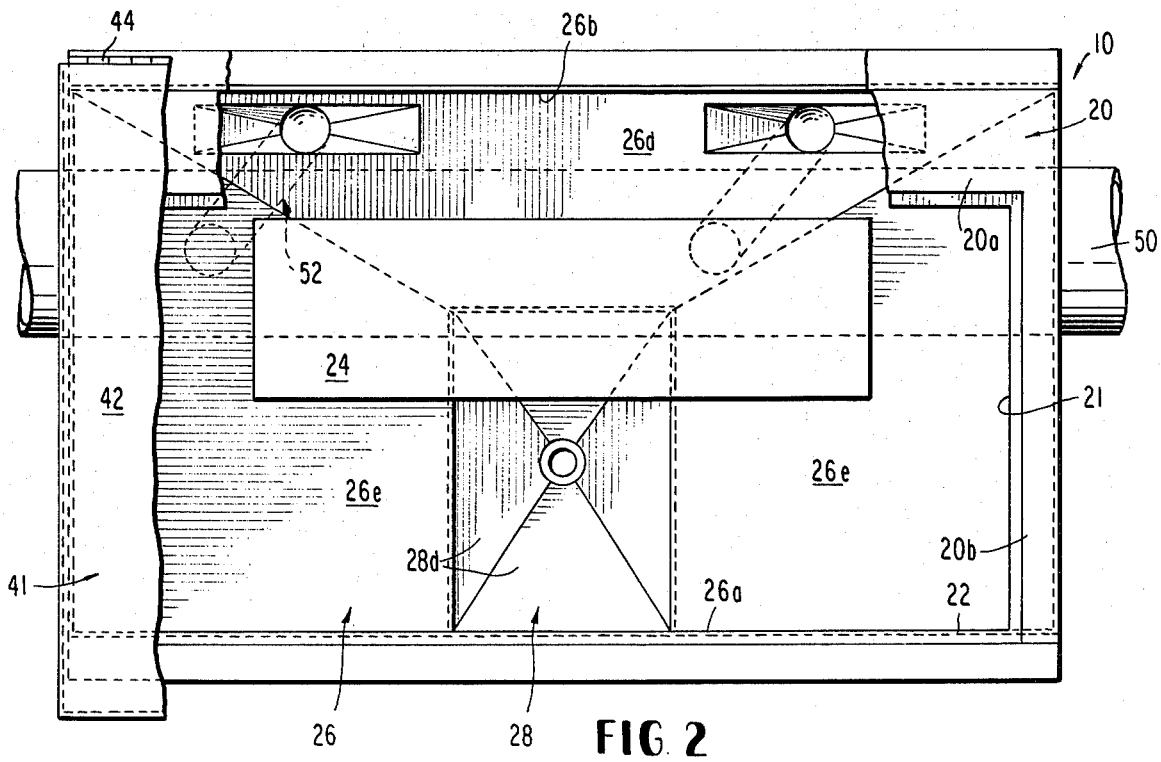
FIG. 2 is a top plan view of the coal washability table shown in FIG. 1, partially broken away, with the upper lid pivoted to horizontal, closed sink position.

Of particular importance is the nature in which the interior 27 of the sink is vented, this being accomplished preferably by the utilization of paired elongated register openings 64 formed within the inclined rear wall **26*b* of the sink 26 on opposite sides of the sump tank 28 and to the rear of that tank as may be seen in FIG. 2. The register openings 64 open to the interior of register boots 62 which are of frustoconical form, being rectangular in cross-section at their upper ends and circular in cross-section at their lower ends and each being coupled to an elbow 54 of the assembly 52 by means of a circular sleeve 60 and achieving sealed coupling between these members. The register boots 62 therefore define openings which are elongated so as to pick up vapors emanating readily from the sump tank 28 when open or from points within the recessed sink cavity remote from tank 28 or even from the room space immediately above the table when the sink lid 40 is raised from the counter 20**.

The placement of the register openings is such that there is little likelihood that any liquid will be spilled down into the ventilation tubing assembly 52, since counter portion **20*a* overlies the same. They are out of the way as are the ventilation tubing assemblies and the main air duct 50**, thus providing no interference to the use of the table in the testing process applied to the coal.

Further, with the lids in place as in FIG. 3, a slight vacuum applied to air duct 50 causes the noxious or toxic vapor fumes to readily enter the ventilation tubing assembly 52 for removal. When the upper lid 40 is raised to the position shown in FIG. 4, and upon removal of the sump tank lid 36, more than adequate ventilation of the work area defined by sink 26 occurs to remove any vapors emanating from the sump tank 28, from the sink 26, during test procedures, as well as from the open top beakers B positioned on the removable shelf 24, recessed below the top of the table.

While the invention has been particularly shown and described with reference to a preferred embodiment thereof, it will be understood by those skilled in the art that various changes in form and details may be made therein without departing from the spirit and scope of the invention.

What is claimed is:

1. An improved coal washability table comprising:

opposed, vertical front and rear walls joined at their ends by vertical end walls and defining an elongated rectangular open frame, opening vertically upwardly, a rectangular sump tank being open at its top and being mounted below the top of said open frame, adjacent to the front wall of said open frame, and being spaced from the end walls and the rear walls of said open frame, a recessed sink mounted within said open frame, overlying said sump tank and opening thereto and including inclined table sink drain walls extending from the rear and opposite ends of said open frame to respective rear and opposite side edges of said sump tank and being joined to the front, rear and end walls of said open frame, a first lid pivotably mounted to the table frame along one edge thereof and overlying the open top of said table frame to completely seal off the frame opening providing access to the recessed sink and sump tank, a removable second lid overlying the open top of said sump tank to selectively close off the recessed sink volume from the sump tank interior, at least one air register opening provided within the table sink inclined drain walls to the rear of the sump tank, a horizontal main air ventilation tube underlying said sink and extending longitudinally through said rectangular open frame, and a ventilation tube assembly coupled at one end to said underlying main air ventilation tube and being connected at its opposite end to said at least one air register opening such that when said underlying main air ventilation tube is subjected to low vacuum pressure, toxic and/or noxious vapors created during the performance of separation tests on coal submergable within an organic liquid provided to the sump tank are readily removed from the area of the recessed sink and the sump tank.

2. The coal washability table as claimed in claim 1, wherein said at least one air register opening are two in number and are provided within said table sink inclined drain wall to the rear of and to respective sides of the sump tank, and wherein separate ventilation tube assemblies are coupled at one end to said main air ventilation tube at one end, and to respective air register openings at their other ends via register boots which flare outwardly at the ends remote from said ventilation tube assemblies and terminate in open ends corresponding in size and configuration to said elongated register openings within the rear inclined drain wall of said sink and being sealably joined to said drain wall about said openings.

3. The coal washability table as claimed in claim 2, further comprising a horizontal counter overlying said table open frame and having a rectangular access opening extending longitudinally from one end of said sink to the other and from the front of said sink towards the rear, but terminating short of the rear such that said counter overlies said air register openings to prevent liquid from readily penetrating said air register openings and entering said main air ventilation tube.

4. The coal washability table as claimed in claim 3, wherein an elongated rectangular shelf is mounted across the rear of said sink below said access opening and extending from one lateral sloped wall portion of said sink to the other and overlying a portion of said sump tank to permit beakers employed during the testing process to rest thereon.

5. The coal washability table as claimed in claim 1, further comprising a horizontal counter overlying said table open frame and having a rectangular sink access opening extending longitudinally from one end of said sink to the other and from the front of said sink towards the rear, but terminating short of the rear such that said counter overlies said at least one air register opening to prevent liquid from readily penetrating said at least one register opening and entering said main air ventilation tube.

6. The coal washability table as claimed in claim 4, wherein an elongated rectangular shelf is mounted across the rear of said sink below said access opening and extending from one lateral sloped wall portion of said sink to the other and overlying a portion of said sump tank to permit beakers employed during the testing process to rest thereon.

* * * * *